United States Patent [19]

Woog et al.

[11] Patent Number: 4,802,961

[45] Date of Patent: Feb. 7, 1989

[54] SILVER REMOVAL APPARATUS AND METHOD

[76] Inventors: Manfred J. Woog, 1960 "B" St.; Charles W. Schmidt, 340 School St., both of Craig, Colo. 81625

[21] Appl. No.: 137,272

[22] Filed: Dec. 23, 1987

[51] Int. Cl.[4] ..... C25C 1/20; C25B 15/08

[52] U.S. Cl. ..... 204/109; 204/237; 204/275; 204/229; 204/272; 204/273

[58] Field of Search ..... 204/109, 229, 237, 271, 204/273, 275, 272

[56] References Cited

U.S. PATENT DOCUMENTS

| | | | |
|---|---|---|---|
| 3,003,942 | 10/1961 | Cedrone | 204/109 X |
| 3,431,187 | 3/1969 | Lancy | 204/109 |
| 3,715,291 | 2/1973 | Bentley | 204/229 X |
| 3,901,777 | 8/1975 | Bentley | 204/109 |
| 3,964,990 | 6/1976 | Woyden | 204/109 X |
| 4,276,147 | 6/1981 | Epner | 204/275 X |
| 4,305,805 | 12/1981 | Edgerton et al. | 204/275 X |
| 4,675,085 | 6/1987 | Vasquez | 204/109 X |
| 4,728,408 | 3/1988 | Palazzolo | 204/275 X |

*Primary Examiner*—Donald R. Valentine

*Attorney, Agent, or Firm*—Arnold B. Silverman

[57] ABSTRACT

A compact, self-contained, automatic electrolytic unit for recovery of silver. The apparatus includes a housing having a reservoir for unprocessed solution, an electrolytic cell disposed within the housing having a stationary cathode and anode in relative spaced relationship, a circulating pump for receiving solution being processed from the cell and returning the same to the cell with or without the addition of unprocessed solution. A metering pump may be employed to add additional unprocessed solution. It is preferred to deliver the solution within the cell at a plurality of locations so as to maintain the cell in a turbulent state. Sensors are provided for determining the level of unprocessed solution within the reservoir and overflow from the cell may be delivered exteriorly of the housing to a tailing unit for further processing. It is preferred that the reservoir, cell and pumps be maintained within a compact housing. The method of the invention involves delivering unprocessed solution from the reservoir to the cell in a manner to establish turbulence within the cell and recirculating solution removed from the cell to the cell so as to enhance efficiency of operation.

27 Claims, 5 Drawing Sheets

SILVER REMOVAL APPARATUS AND METHOD

BACKGROUND OF THE INVENTION

1. Field Of The Invention

The present invention relates to a compact apparatus and an associated method for removing silver from solution such as photographic solutions so as to reclaim the silver.

2. Description Of The Prior Art

Various means have been known for removal of silver from solutions including photographic solutions containing silver picked up during processing. It has ben known to employ the electrolytic process for the recovery of silver from solutions.

The removal of silver from solutions such as photographic solutions is not only important in terms of the desire to reclaim the silver, but also is critical in order to comply with the standards of the United States Environmental Protection Agency which limits silver in discharged material to less than 5 parts per million.

There has been lacking in the prior art a compact, inexpensive, self-contained fully automatic system which will facilitate compliance with Environmental Protection Agency standards while providing efficient reclamation of the silver.

SUMMARY OF THE INVENTION

The present invention has met the above-described need by providing a compact unit and associated methd which facilitates efficient withdrawal of silver from solutions.

In a preferred practice of the invention a housing has a reservoir for unprocessed solution and also contains an electrolytic cell which has stationary cathodes and anodes. Circulating pump means are provided for delivery of unprocessed silver containing solution and for recirculating solution which is withdrawn from the cell and is subsequently returned thereto. First conduit means deliver solution from the circulating pump to the cell and have a portion which has a plurality of discharge outlets within the cell so as to maintain the solution in the cell in a state of turbulence and thereby enhance interaction between the cathode and the solution. Second conduit means return solution from a lower portion of the cell to the circulating pump. A metering pump is operatively associated with the reservoir for automated delivery of unprocessed solution to the cell. Sensing means are provided within the reservoir to create an indication of the quantity of unprocessed solution within the reservoir.

Overflow means are provided to deliver overflowing solution from the cell to the exterior of the housing preferably to a tailing unit such as an ion exchange device.

The method of the present invention involves employing apparatus exemplified by this apparatus wherein unprocessed solution is delivered to the cell and solution while being processed is withdrawn from the cell and recirculated to maintain turbulence within the cell so as to enhance efficiency of the cell's operation.

It is an object of the present invention to provide a compact, fully automatic and inexpensive system which will efficiently withdraw silver from solution such as discarded photographic processing solutions.

It is a further object of the invention to provide such a system wherein the processing will result in compliance with the United States Environmental Protection Agency standards for discharged material.

It is a further object of the present invention to provide such a system which is provided with suitable safeguards to warn of malfunctioning.

It is a further object of the present invention to apply such a system which may be operated effectively by relatively unskilled workman.

It is a further object of the invention to provide such a system which is adapted to process small amounts of solution as well as large tank quantities, to sense the amount and react accordingly.

These and other objects of the invention will be more fully understood from the following description of the invention on reference to the illustrations appended hereto.

DESCRIPTION OF THE PREFERRED EMBODIMENTS

The expression "photographic solutions" as used herein shall refer to silver-containing solutions which are solutions which result from or are employed in photographic processing and shall expressly include but not be limited to fixer solutions and bleach fix solutions.

As used herein, the expression "solutions" unless modified by specific language in the particular context, shall mean silver-containing solutions which are to be processed by the present system or are being processed by a system or have been processed by the system.

Figure 1:
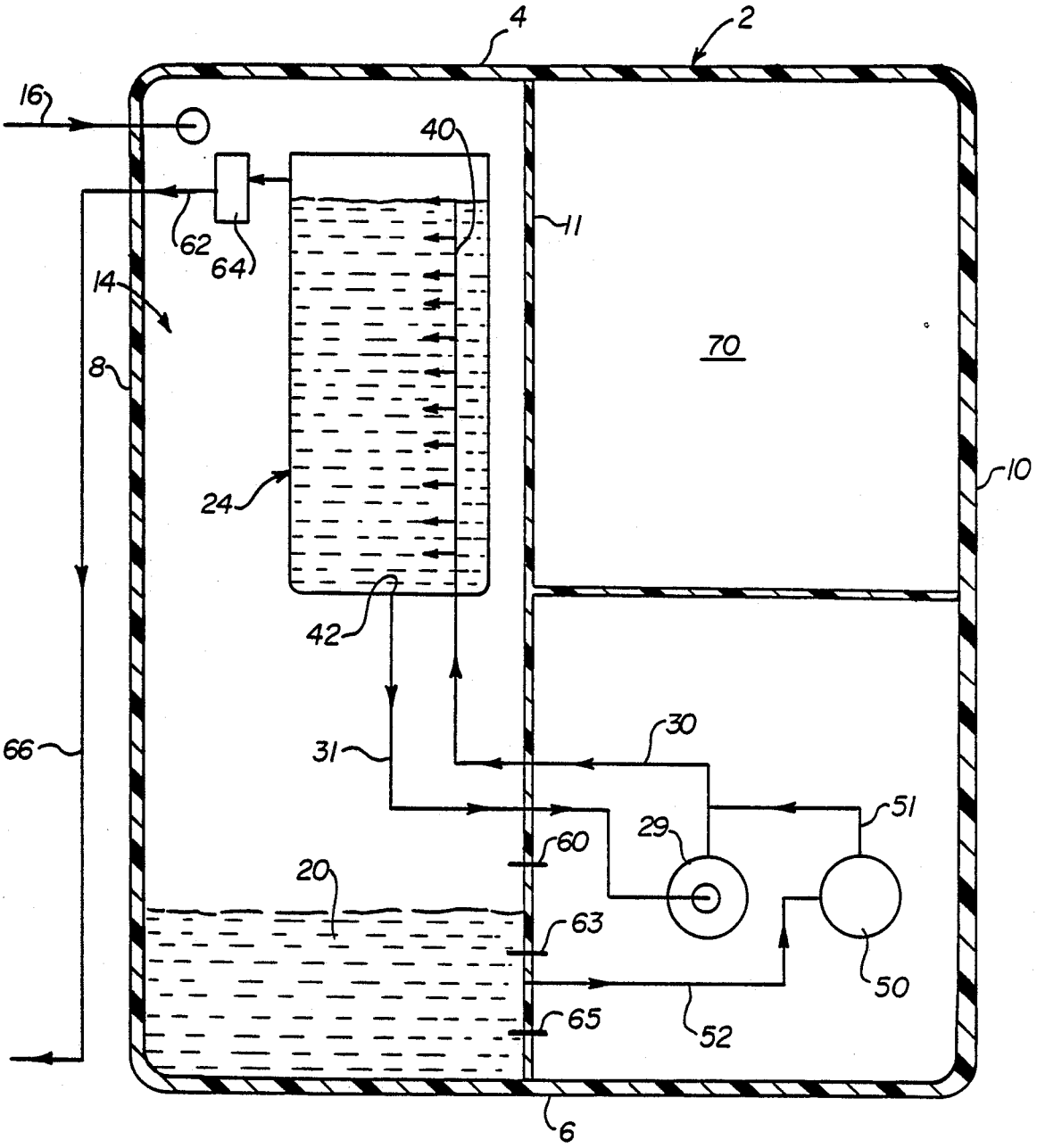
FIG. 1 is a schematic illustration of a form of apparatus of the present invention.

Referring to FIG. 1, there is shown a housing 2 which has upper wall 4, lower wall 6, side walls 8 and 10 and rear and front walls (now shown). This housing may be composed of any desirable material such as a resinous material which will be chemically inert to the materials employed in the process and have adequate strength to function effectively in this use. Among the suitable materials are polyolefins such as polyethylene glass and fiber containing materials such as that sold under the trade designation Fiberglas. The housing 2 is provided with suitable access doors or removable panels (not shown). The left hand portion of the housing as defined by barrier wall 11 defines an unprocessed solution storage reservoir 14 which may be defined by the housing per se or have an insert container therein. Solution to be processed may be introduced into the reservoir by conduit means 16 in order to provide the desired depth of unprocessed solution 20. Electrolytic cell 24 is preferably contained within the side of the housing 2 which has the reservoir of unprocessed solution 20 and is in overlying relationship with respect thereto. The electrolytic cell 24 contains a stationary cathode (not shown in this figure) and a stationary anode which will be described hereinafter. The cell 24 may advantageously be of generally cylindrical configuration and is preferably composed of a material such as a suitable chemically inert material such as a polyolefin such as polyethylene or a fiber glass containing material. It may be fixedly secured to the housing or insert container. The chemical reaction has long been known in accordance with Faraday's Law.

One of the advantageous features of the present invention is the use of stationary cathode and anode with the cathode being disposable. Prior systems have generally employed a moving cathode to provide turbulence of solution in the desilvering chamber. The anode is preferably composed of a material selected from the group consisting of carbon or stainless steel, such as 316 stainless steel, and the cathode is preferably composed of any suitable material consisting of stainless steel, such as 316 stainless steel. The cathode may, for example, be 5/1000 inch thick stainless steel. The anode and cathode are preferably of solid construction and of a size to fit into cell 24.

Circulating pump 29 through first conduit means 30 delivers solution to the cell 24. A preferred feature of the invention is to provide within the cell a portion 40 of the first conduit means 30 which provides a plurality of solution discharge openings as indicated by the arrows pointing toward the left. This multiple discharge establishes significant turbulence in the cell thereby enhancing the efficiency of exposure or contact between the solution and the cathode and producing more efficient silver removal. Second conduit means 31 is connected to a lower portion of the cell 24 for withdrawal of solution through drain 42 and return of the same to circulating pump 29. This cycling of the solution further enhances turbulence and efficiency of operation.

Third conduit means 52 is in communication with reservoir 14 to provide unprocessed solution to the cell 24. Metering pump 50 delivers the unprocessed solution through conduit means 51 to the cell 24. In the illustration shown, conduit means 51 is in communication with conduit means 30 to provide for delivery to the cell.

A suitable metering pump 50 is that sold by Blue and White under the trade designation C6125P.

Suitable circulating pumps 29, are sold by March under the trade designations AC3CPMD.

Sensing means 60, 63, 65 which may be of any desirable type such as one which emits an electrical signal when the solution reaches the level of the sensor, are provided to establish an indication regarding the depth of the unprocessed solution 20 in reservoir 14. When the depth of reservoir reaches a predetermined level, such as the level of sensor 60, for example, a cycle of operation is initiated.

The drain 42 also serves to remove solution from the cell 24 during the period when the system is not operating or there is no solution available for normal desilvering. This serves to resist redissolving of silver on the cathode during such periods. Also, a timer (not shown) is employed to shut down the system after a predetermined time period in order to effect the desired desilvering process time. In order to take care of overflow from the cell 24 conduit means 62 delivers such overflow through warning chamber 64 through housing wall 8 and conduit 66 to dispose of the same. Delivery may be to a tailing device which is preferably an ion exchange device which removes any residual silver present so as to ensure the discharge solution to the drain will have less than 5 parts per million of silver. Element 64 is a two level alarm unit which is adapted to provide an indication that the cell column needs to be replaced or that the conduit 66, tailing device or output hose from the tailing device, has a flow restriction. The former may be referred to as a column change alarm and the latter a high level alarm.

In section 70 of the housing are the electronic controls.

It will be appreciated that the metering pump 50 will produce an output of unprocessed solution equal to the amount of overflow solution withdrawn from the system by conduit 62, 66. This may be on the order of about 100 cubic centimeters per minute, for example.

It will be appreciated that one of the benefits of this invention is that it provides a compact unit which is preferably contained within a unitary housing.

Figure 2:
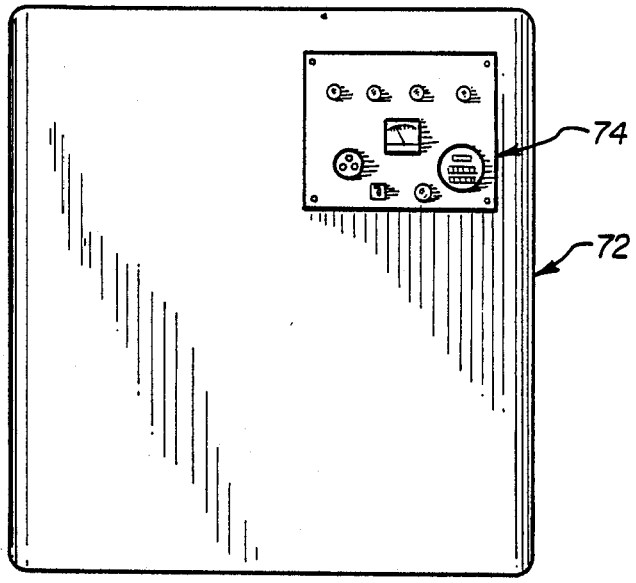
FIG. 2 is a front elevational view of the housing showing a control panel.
Figure 3:
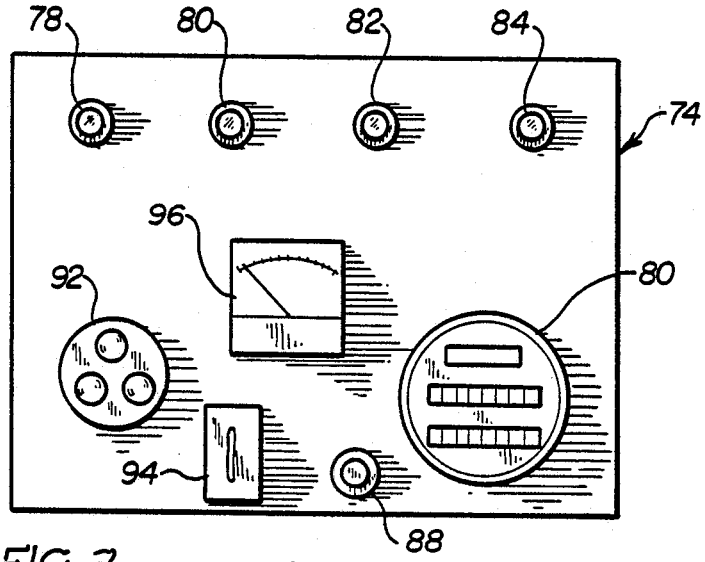
FIG. 3 is a more detailed illustration of the conrrol panel.

Referring to FIGS. 2 and 3 there is shown a front panel 72 of the housing which contains a control panel 74. This control panel provides a great deal of information to the user. Within the upper portion of the panel are a series of four lights which are, respectively, a standby light 78 indicating that the unit is not operating, an operating light 80 indicating that the unit is operating, a change column light 82 indicating that the tailing device needs to be changed or that there is a flow restriction in conduit 66 or discharge hose and a high level alarm 84 indicating a more urgent need to change the tailing device or such a blockage. Indicator 96 provides a reading as to how many hours a system has been in use since the initiation of each desilvering cycle. Fuse 88 is a replaceable fuse and 80 is an amp gauge indicating the current level applied in the cell 24. Element 92 is the speaker for the audible alarm and 94 is a key switch for turning the system on and off. A suitable audible alarm is the Mallory Sonalert SC110. It will be appreciated that various types of control panels with similar or different informational presentations and controls may be provided if desired.

As electrical means for operating the system will be obvious to those skilled in the art, details are not provided herein.

Figure 4:
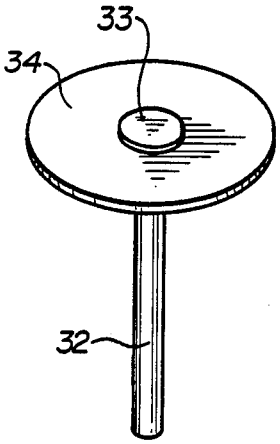
FIG. 4 is a perspective view of a form of anode employed in the present invention.

Referring more specifically to FIG. 4, there is shown a preferred form of anode 32 which is preferably a solid generally cylindrical rod which is secured in downward depending relationship from disc 34. Disc 34 is made of an electrically insulative material such as an acrylic material, for example. The disc 34 is so sized as to serve as a closure for cell 24.

Figure 5:
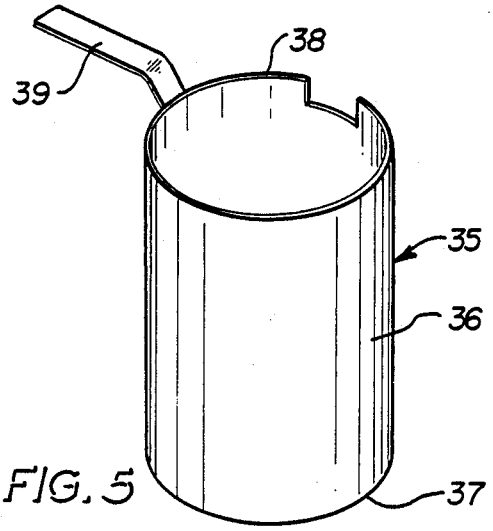
FIG. 5 is a perspective view of a form of cathode employed in the present invention.

A form of cathode 35 is shown in FIG. 5. The cathode is generally tubular and has body 36 which has upper and lower openings 37, 38. An electrically conductive tab 39 projects upward and outward to facilitate making an electrical connection to the cathode 35. Electrical connection to the anode 32 may conveniently be made at its upper end 33 which passes through disc 34.

Figure 6:
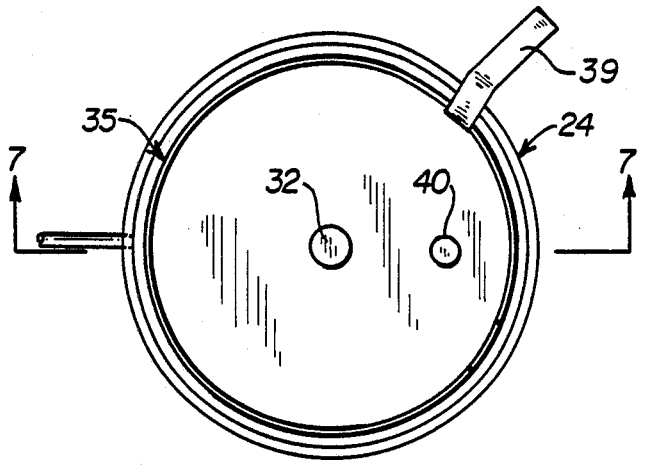
FIG. 6 is a top plan view of the electrolytic cell disposed within the housing.
Figure 7:
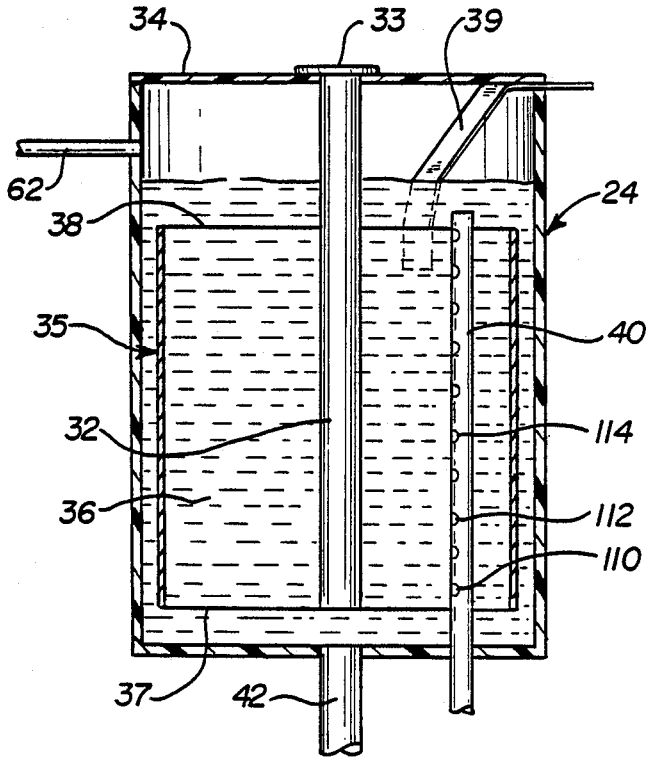
FIG. 7 is a cross-sectional illustration of the housing taken through 7–7 of FIG. 4.

FIGS. 6 and 7 show the cell 24 with the anode 32, disc 34, cathode 35, portion 40 of first conduit means 30 and other hereinbefore identified elements of the cell. It will be appreciated that the cathode 35 has a diameter which is slightly smaller than the interior diameter of cell 24 and an axial extent greater than one-half the axial extent of cell 24. The cathode 35 is positioned in spaced surrounding relationship with respect to the centrally disposed anode 32.

The silver will adhere to the inner surface of the cathode 35.

Referring to FIGS. 6 and 7 further details of the cell will be considered. As is shown in these figures, the cell has a generally cylindrical configuration with an open top. The cell may, for example, have a diameter of about 6 inches and a height of about 10 inches. The extension 40 of the first conduit means 30 has a plurality of discharge openings such as 110, 112, 114 with the preferred size of each opening being about 3/32 inch and the preferred number of openings being about 1 to 15 per inch of section tube 40. The reservoir is preferably a separate unit inserted or constructed within the housing and may be composed of material (such as Fiberglas) which possesses adequate strength, is economically feasible and is not attacked by the solution. The reservoir may be about 24 inches in height, about 11 inches in width and about 12 inches in depth.

EXAMPLE

In order to provide a more detailed understanding regarding the invention an example will be considered. An apparatus of the above-described type has a housing which has a height of 24 inches, a width of 24 inches and a depth of 12 inches within which are disposed a cell having a height of 10 inches and a diameter of six inches. The system is operated at a current of about 3.24 to 11.50 amps. The circulating pump 29 delivers and recirculates solution being processed at a rate of about 9.75 gallons per minute while the metering pump delivers unprocessed solution to the system at a rate of about 100 to 130 cc/min which is generally equal to the rate of overflow discharge of solution through conduit 62, 66 as well as input by way of conduit means 16. The original solution in its unprocessed state contained about 0.25 to 0.65 troy ounces of silver per gallon silver and the solution emerging through conduit 62 has about less than or equal to 5 parts per million of silver.

If the system is operating at high efficiency at about 8 amperes for one hour about 1 troy ounce of silver will be recovered.

In order to remove the silver, the cathode 35 is removed from the cell 24. Depending upon the quality of the plating of the silver on the cathode 35 one may flex the cathode 35 to detach the silver and subsequently reuse the cathode 35 after cleaning. It is generally desirable to remove the cathode 35 when the silver coating thickness on the cathode is about ¼ to ½ inch thick.

It will be appreciated that in the method of the present invention unprocessed solution is introduced into the system through conduit 16 and is stored in reservoir 14 until sensors 60, 63, 65 determine that a desired level of solution is present. At that time, unprocessed solution is withdrawn from reservoir 14 by way of conduit 52 by means of metering pump 50 which introduces it into the system. Circulating pump 29 delivers solution through conduit 30 and extension 40 which generates turbulence within the cell and drain 42 returns the solution to the circulating pump 29. Anode 32 and cathode 35 are then electrically energized to create electrolytic action in cell 24. As the electrolytic process is continued, silver will adhere to the cathode with the cathode in the preferred form of the invention being inexpensive and disposable, but can be reused, if desired. Removal of the cathode 35, therefore, removes the silver which has been deposited on the cathode. The turbulence enhances the efficiency of contact between the cathode 35 and the solution and thereby improves the silver recovery process. When the solution level in reservoir 14 is below a desired sensor 60, 63, 65, the system shuts down until the next cycle and the appropriate warning light 82 or 84 illuminated when a tailing system blockage problem exists.

Figure 8:
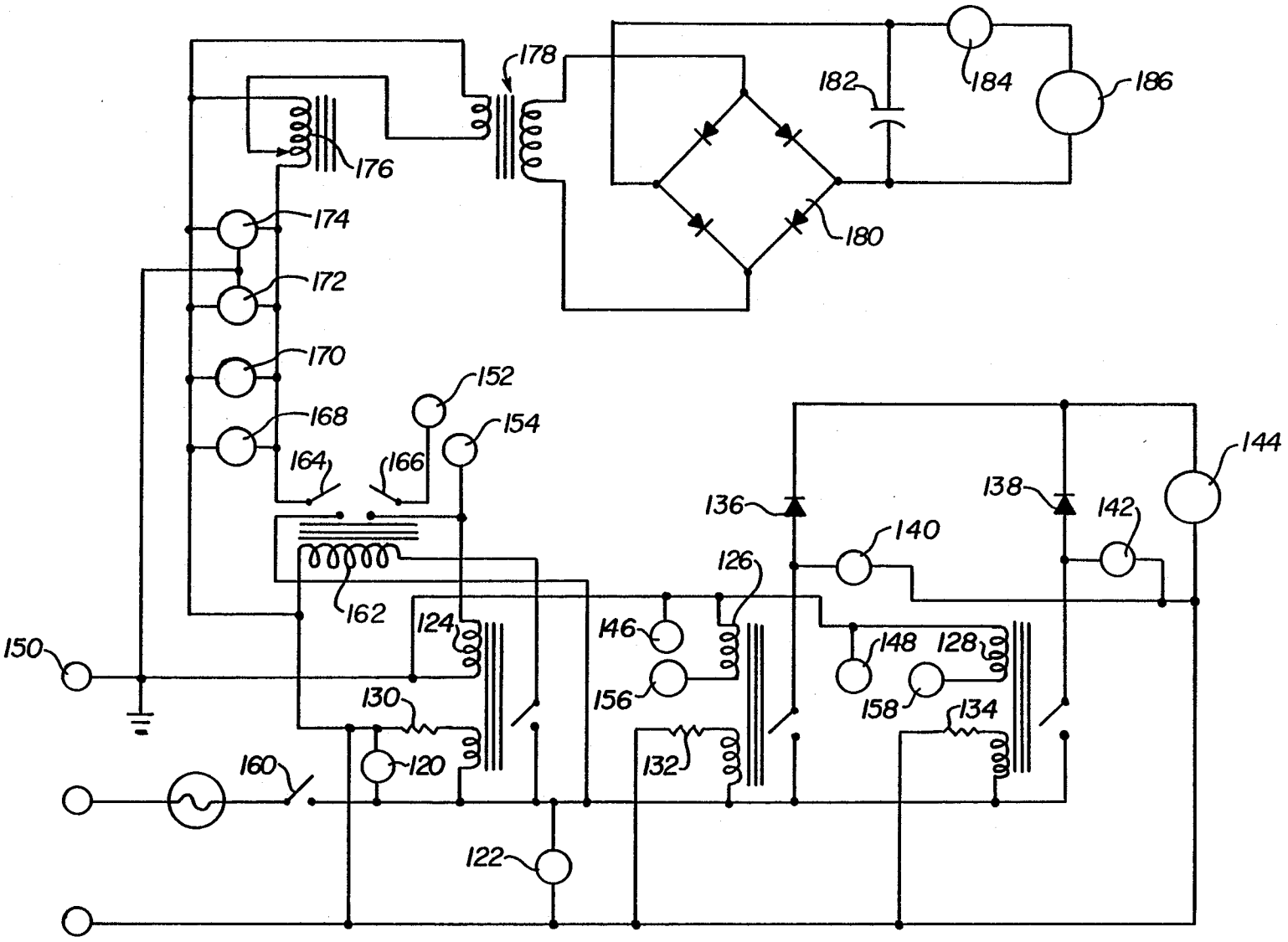
FIG. 8 shows an electrical circuit diagram usable in the present invention.
Figure 9:
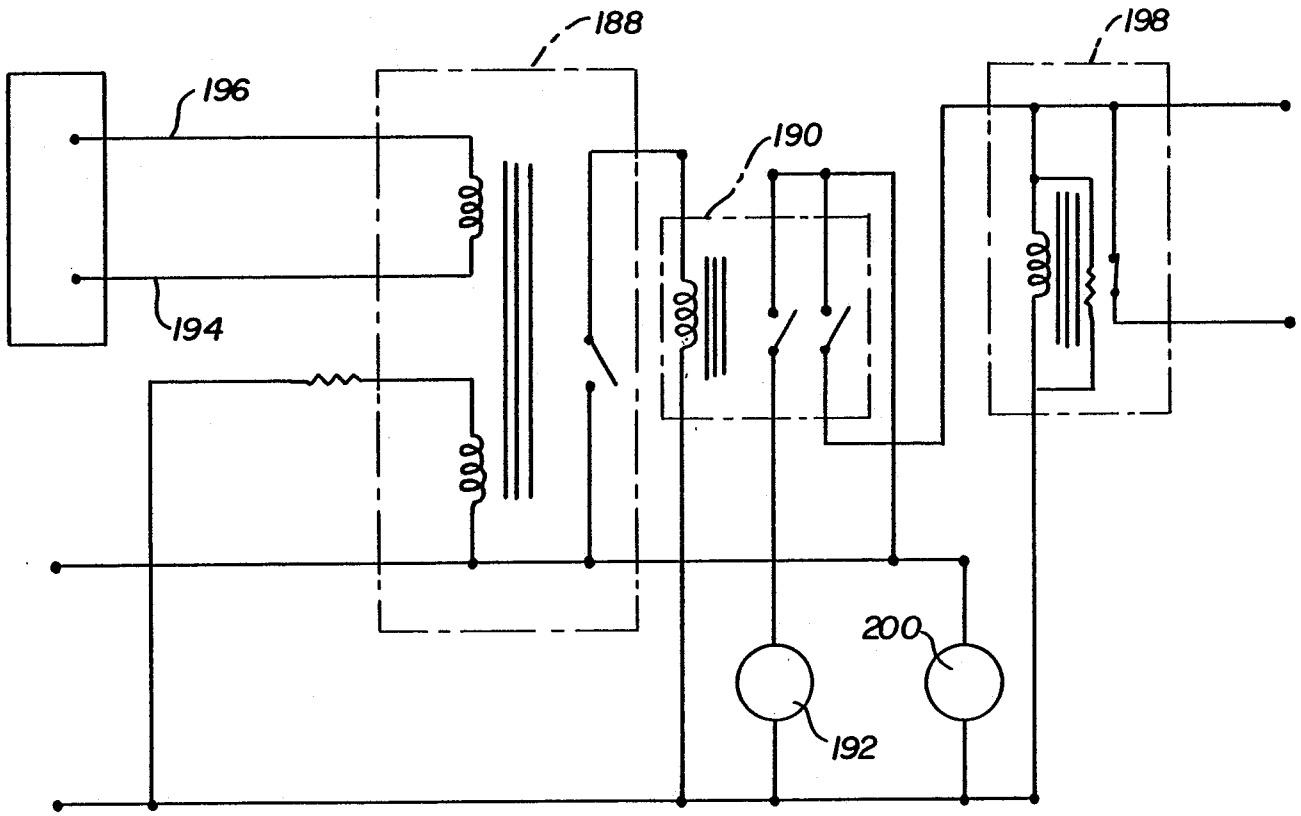
FIG. 9 shows a modified form of circuit diagram.

Turning to the electrical circuits shown in FIGS. 8 and 9, two variations will be considered. Where the photographic solution to be treated is a bleach fix solution i.e. one that contains a highly active rron additive referredto as E.D.T.A. which tends to redissolve silver on the cathode, the circuit of FIG. 9 will generally be employed.

The circuits of FIGS. 8 and 9 facilitate efficient automated operation of the various phases and cycles of the system. The system is adapted to react to the volume of incoming solution to be treated and cycle it as necessary in order to desilver the solution without having the operator being required to constantly monitor operation. At the time of setup of the system, the volume and current settings are set in the system and do not generally need to be reset unless major changes in the incoming solution take place.

Referring in greater detail to FIG. 8, a standby lamp 120 turns on when the key switch 160 is turned on. This indicates that the unit is awaiting sufficient incoming unprocessed dissolution into the reservoir 14 to turn the unit into an operating mode. The fan 122 is also turned on when the switch 160 is turned on. This fan preferably runs continuously. A series of isolation relays 124, 126, 128 are, in the systems standby mode, supplied with power to their primary coils. Isolation relay 124 is for the main reservoir operating level sensors, isolation relays 126 is for the column change level sensor and isolation relay 128 is for the high level alarm sensor. Resistors 130, 132, 134 serve respectively to protect isolation relays 124, 126, 128 from power surges.

Diodes 136, 138 serve to resist current backflow to the alarm light, column change light or high level alarm light while both use the same alarm 144 for the audible alarm. The column change light 140 comes on if the sensor in the warning chamber indicates the need to change a column. The high level light 142 comes on if the sensor in the warning chamber indicates too high a fluid level in the device. Alarm 144 is preferably a Sonalert which comes on if high level or column chain sensors are activated. Ground sensors 150, 146, 148 correspond to the sensors 60, 63, 65 in reservoir 14 and are connected to the isolation relays 124 126, 128 for level sensing. Low level sensor 152 is associated with isolation relay 124 in order to keep the device operating until the solution level is below this sensor. Bilevel sensor 154 is associated with isolation relay 150, 124 to indicate sufficient solution in the reservoir to turn the device on to the operating mode. Column change sensor 156 which is disposed in the warning chamber is for isolation relay 126 and turns on column change lamp 140 and Sonalert 144 if activated. High level sensor 158 is also in the warning chamber. It serves to isolate relay 128 which turns on high level lamp 142 and Sonalert 144 if activated. Key switch 160 is the on/off switch for the entire system.

General purpose relay 162 is activated when sufficient solution is in the reservoir to actuate sensor 152 and isolation relay 124. This relay closes points between 152, 154 when solution reaches 154 and entire device stays on until the solution goes below the level of sensor 152. This relay also plays the dual role of closing contacts 164, 166 in order to carry the needed current load to operate the entire device. When the general purpose relay 162 is activated and contacts 164, 166 are closed, the current is then passed onto the hour meter 168 which records the operation time, operating at lamp 170 to indicate that the device is in the operating mode, the metering pump 172 which introduced unprocessed solution from the reservoir into the desilvering cell, the circulating pump 174 which creates desired turbulation in the desilvering cell and the variable transformer 176 which supplies a varying current to the primary side of the power transformer 178 which serves to supply step-down AC voltage from its secondary side to a full wave rectifier 180. The capacitor 182 serves to withdraw any spikes or ripples in the current in order to supply clean, filtered DC current to the cathode and anode in order to optimize desilvering to limit such as five parts per million. The amp meter 184 serves to monitor current level to the cathode and anode in the desilvering cell. The desilvering cell 186 houses the cathode and anode for desilvering of solution.

In FIG. 9 there is shown the ciruit preferred for use with the bleach fix solutions. These are components which are added to the circuit of FIG. 8. From the output of general purpose relay 162 are added the following which are activated when the relay 162 is activated. An additional level sensor 196 is placed in the cell 186 (FIG. 8) to determine when the cell has sufficient solution to start the desilvering cycle at which point the primary coil 162 is activated. The left hand switch in dual purpose relay 190 closes without power to the coil and transfer pump 192 activated in order to fill the cell. When the cell is full, level sensor 196 closes the contacts in isolation relay 188 which in turn activates contacts in dual purpose relay 190 to open the switch at the left and shut off the fuel pump 192 which serves to close contacts of the right hand switch in general purpose relay 190 in order to activate time delay relay 198 which is preferably adjustable for about 0 to 2 hours. Time delay relay 198 serves to hold back the metering pump 172 (FIG. 8) and allow the circulation pump 174 of variable transformer 176, power transformer 178, full wave rectifier 180, capacitor 182, amp meter 184 and cell 186 to desilver the solution therein to five parts per million of silver before turning on metering pump 172 and adding more unprocessed solution. This cycle continues until the solution level falls below low level sensor 152 (FIG. 8) and the device shuts down to the standby mode as in the circuit of FIG. 8.

It will be appreciated that other forms of electrical circuits will be known to those skilled in the art in cnnection with the desirable approach to operating the system.

It will be appreciated, therefore, that the present invention provides an effective means for providing a compact, self-contained unit which is economically feasible and technically efficient in compliance with EPA standards regarding discharge of material containing silver and limitations thereon.

It will be appreciated that the present disclosure for convenience of reference has emphasized photographic solutions, it will be appreciated that the system is equally applicable to other silver-containing solutions which may be subjected to silver reclamation processes through electrolytic cells.

In the form disclosed, the invention is adapted for use with a wide variety of silver containing solutions such as solutions resulting from photographic processing. Use in a bleach fix solution makes it desirable to drain cell 24 through drain 42 when the system is not in use in order to resist redissolving silver which is on the cathode. Such draining is not necessary when using the invention with a fixer solution, for example. In the former case it may be desirable to provide an additional pump, not shown, to fill the cell before initiating the next cycle.

Whereas particular embodiments of the invention have been described above for purposes of illustration, it will be appreciated by those skilled in the art that numerous variations of the details will be made without departing from the invention as described in the appended claims.

We claim:

1. Apparatus for recovering silver from solutions comprising a housing having a reservoir for storage of unprocessed solution, electrolytic cell means having a stationary anode and a stationary cathode disposed therein in relative spaced relationship, circulating pump means for delivering solution to be processed from said reservoir to said cell, first conduit means for delivering said solution from said circulating pump to said cell, second conduit means for returning said solution from said cell to said circulating pump means, said circulating pump means adapted to deliver said returned solution to said cell, and overflow means for withdrawing said solution from said cell to the exterior of said housing.

2. The apparatus of claim 1 including said electrolytic cell means disposed within said housing.

3. The apparatus of claim 2 including said cell being disposed in overlying relationship with respect to said reservoir.

4. The apparatus of claim 2 including said first conduit means including a dispensing end portion disposed within said cell, said dispensing end portion having a plurality of outlets for distributing said solution within said cell at a number of regions, whereby said multiple distribution will enhance the turbulence within said cell and enhance efficiency of operation of said cell.

5. The apparatus of claim 4 including sensor means for determining the level of said unprocessed solution in said reservoir.

6. Apparatus for recovering silver from solutions comprising a housing having a reservoir for storage of unprocessed solution, electrolytic cell means having a stationary anode and a stationary cathode disposed therein in relative spaced relationship, circulating pump means for delivering solution to be processed from said reservoir to said cell, first conduit means for delivering said solution from said circulating pump to said cell, overflow means for withdrawing said solution from said cell to the exterior of said housing, said electrolytic cell means disposed within said housing, said first conduit means including a dispensing end portion disposed within said cell, said dispensing end portion having a plurality of outlets for distributing said solution within said cell at a number of regions, whereby said multiple distribution will enhance the turbulence within said cell and enhance efficiency of operation of said cell, second conduit means for returning said solution from said cell to said circulating pump means, said circulating pump means adapted to deliver said returned solution to said cell, and sensor means for determining the level of said unprocessed solution in said reservoir;

said sensor means having means for measuring the depth of said unprocessed solution at a number of levels within said reservoir.

7. The apparatus of claim 6 including metering pump means for delivering predetermined quantities of said unprocessed solution to said cell.

8. The apparatus of claim 7 including third conduit means connecting said reservoir with said metering pump for delivery of said unprocessed solution to said metering pump.

9. The apparatus of claim 8 including fourth conduit means for supplying said unprocessed solution from said metering pump directly or indirectly to said cell.

10. The apparatus of claim 9 including said overflow means having means for delivery of said overflowing solution to a tailing unit.

11. The apparatus of claim 10 including said tailing unit including ion exchange means for removing silver from said processed solution.

12. The apparatus of claim 10 including means for delivering unprocessed solution to said reservoir.

13. The apparatus of claim 8 including means for turning on said apparatus when the level of said unprocessed solution in said reservoir is above a predetermined level.

14. The apparatus of claim 13 including said second conduit means communicating with a lower portion of said cell.

15. The apparatus of claim 14 including said circulating pump and metering pump are disposed within said housing.

16. The apparatus of claim 15 including said reservoir having a height of about 16 to 30 inches, a width of about 16 to 30 inches and a depth of about 8 to 16 inches.

17. The apparatus of claim 8 including said cathode being disposed in spaced surrounding relationship with respect to said anode.

18. The apparatus of claim 17 including said anode being elongated, a disc member secured to one end of said anode, and said disc being a closure for said cell.

19. The apparatus of claim 18 including said dispensing end of said first conduit means being disposed within said cathode.

20. A method of recovering silver from photographic process solutions including providing a housing having an unprocessed solution reservoir and an electrolytic cell containing an anode and a cathode disposed in relative spaced relationship, providing pump means for delivering unprocessed solution to said cell, maintaining said solution in said cell in a state of turbulence, providing said pump means with a circulating pump for receiving solution from said cell and returning said solution to said cell and metering pump means for providing additional solution to said cell, and periodically adding unprocessed solution to said cell directly or by means of said metering pump.

21. The method of claim 20 including sensing the level of unprocessed solution within said reservoir, and initiating said process when said unprocessed solution reaches a predetermined level.

22. The method of claim 21 including disposing of overflow from said cell exteriorly of said housing.

23. The method of claim 22 including periodically replacing said cathode.

24. The method of claim 23 including providing a tailing unit disposed exteriorly of said housing for receipt of said overflow and removal of any silver contained therein.

25. The method of claim 24 including periodically delivering said unprocessed solution to said reservoir.

26. The method of claim 25 including establishing a current level within said cell as function of the anticipated range of silver content within said unprocessed solution.

27. The method of claim 26 including maintaining said anode and said cathode in stationary position during said process.

* * * * *

UNITED STATES PATENT AND TRADEMARK OFFICE

CERTIFICATE OF CORRECTION

PATENT NO. : 4,802,961

DATED : February 7, 1989

INVENTOR(S) : MANFRED J. WOOG and CHARLES W. SCHMIDT

It is certified that error appears in the above-identified patent and that said Letters Patent is hereby corrected as shown below:

Column 1, line 14, "ben" should be --been--.

Column 1, line 30, "methd" should be --method--.

Column 6, line 11, "rron" should be --iron--.

Column 7, line 53, "cnnection" should be --connection--.

Claim 26, column 10, line 44, --a-- should be inserted between "as" and "function".

Signed and Sealed this

Nineteenth Day of December, 1989

*Attest:*

JEFFREY M. SAMUELS

*Attesting Officer*

*Acting Commissioner of Patents and Trademarks*